United States Patent [19]

King

[11] Patent Number: 4,544,431

[45] Date of Patent: Oct. 1, 1985

[54] ROLL FED LABELLING MACHINE

[75] Inventor: George W. King, Scarborough, Canada

[73] Assignee: Stackpole Limited, Scarborough, Canada

[21] Appl. No.: 698,919

[22] Filed: Feb. 6, 1985

[51] Int. Cl.[4] ..... B65C 19/04

[52] U.S. Cl. ..... 156/256; 156/291; 156/353; 156/355; 156/363; 156/449; 156/458; 156/521; 156/548; 156/566

[58] Field of Search ..... 156/350, 351, 353–355, 156/361–364, 521, 522, 518, 520, 453–455, 356–357, 578, 566, 250, 256, 448–449, 456–458, 291, 548

[56] References Cited

U.S. PATENT DOCUMENTS

| | | | |
|---|---|---|---|
| 3,955,481 | 5/1976 | Heitmann | 53/137 X |
| 4,108,710 | 8/1978 | Hoffmann | 156/521 X |
| 4,248,655 | 2/1981 | Kerwin | 156/363 X |
| 4,323,416 | 4/1982 | Malthouse et al. | 156/521 |
| 4,397,709 | 8/1983 | Schwenyer | 156/522 X |

*Primary Examiner*—David Simmons

[57] ABSTRACT

The apparatus of the present invention processes roll fed labels for application to articles to be labelled. Adhesive is applied to or activated on the leading edge of the first to be applied label and the label is subsequently cut from the label supply and advanced by a conveyor in timed synchronization with an article to be labelled. Preferably, adhesive is applied to or activated on the leading edge of such first label as it is held essentially stationary on a vacuum bed in slipping engagement with continuously driven belts.

20 Claims, 6 Drawing Figures

FIG. 4.
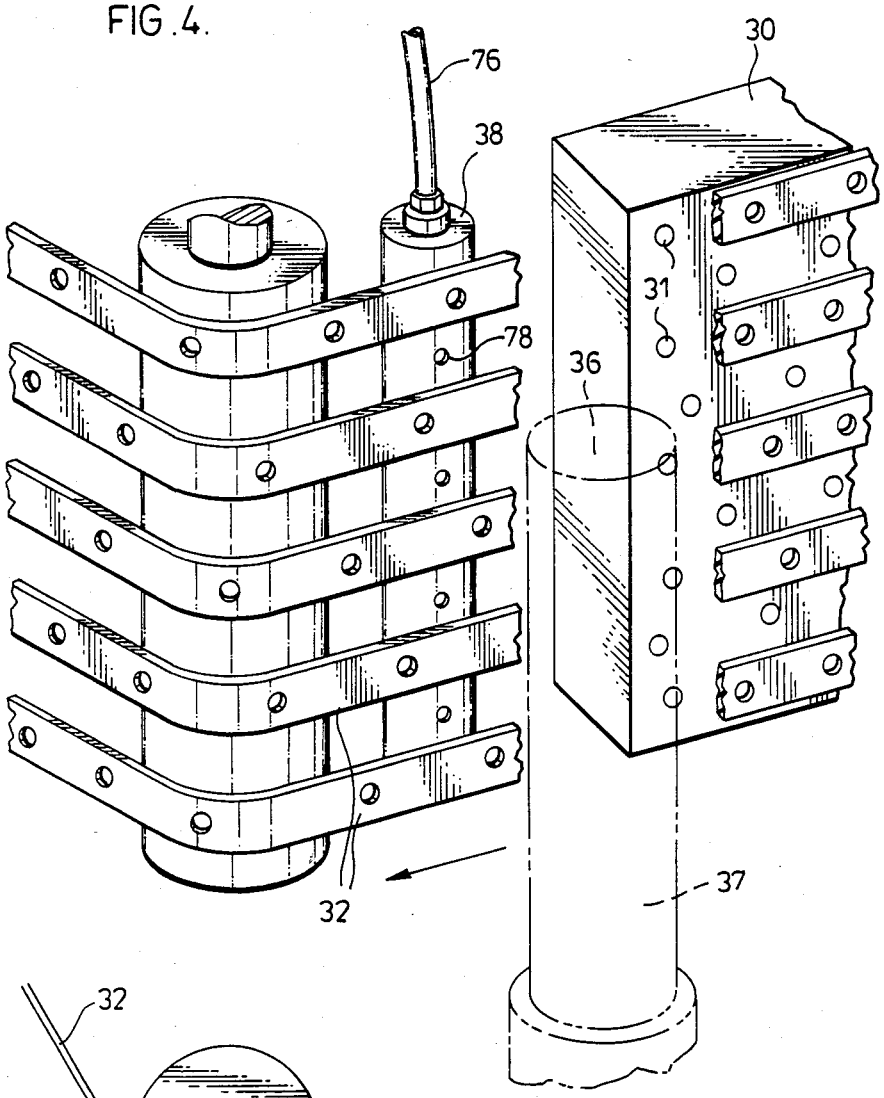
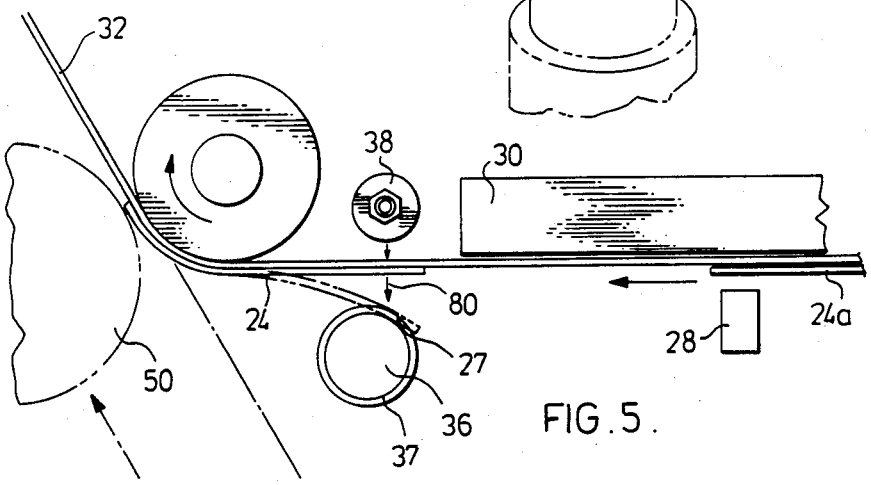
FIG. 5.

ROLL FED LABELLING MACHINE

BACKGROUND OF THE INVENTION

The present invention relates to labelling apparatus for applying labels to the outer surface of a container or article to be labelled. In particular, the invention is related to a method and apparatus of cutting a label from a roll-fed supply, applying adhesive to or activating adhesive on the rear face of the labels and moving the labels in time synchronization with an article to be labelled.

In the past, a number of different labelling apparatus have been proposed for applying labels to containers or the like by adhering the label to the container and subsequently wrapping the label around the container by rolling the container along a fixed surface. In particular, prior art labellers have been designed for pressure sensitive adhesive labels carried on a backer strip with the backer strip being removed from the labels as the labels are advanced in time synchronization with a container. It is desirable to have a machine capable of withdrawing a label from a roll label supply and apply an adhesive to or activating an adhesive on the back face of the label as necessary for application to a container. Labels which require application of an adhesive are less expensive and have particular application for the new type of plastic containers which are more readily deformable. With containers of this type, an adhesive is often applied to the leading edge and trailing edge of the label with the portion of the label being unsecured.

One such prior art machine is disclosed in U.S. Pat. No. 4,323,416. In this case, the strip of labels is advanced from a roll supply and passed through a cutting mechanism for subsequent engagement by a vacuum drum. The drum in combination with belts moving over the surface thereof, advance the label to the labelling point in time synchronization with an article to be labelled. Adhesive is applied to the rear face of the label as the label is moved past a gluing station.

One of the problems with prior art labellers adapted to applied adhesive to the rear face of a label, prior to or after cutting from a roll label supply, is that it is difficult to apply the adhesive to the label in a controlled manner whereby the conveyor means for advancing the label is not immediately contaminated. This problem is compounded by the speed of movement of the labels to the labelling location.

According to the present invention, a roll-feed labeller is possible which intermittently advances labels to be applied to containers and applies adhesive to at least the leading edge of the label as it is held stationary with respect to a moving conveyor. The adhesive is applied to the first label of a series of roll-feed labels, as it is attached to the series which are engaged upstream of a cutting mechanism. The labels are cut from the label supply in time synchronization with the advance of a container to be labelled to cause the leading edge of a label to meet with a surface of the container to be labelled as they are both advanced past a labelling location. The container advances past the labelling location in a manner to apply the remaining portion of the label to the surface of the container. The method of this apparatus is also part of the present invention.

The invention is also directed to the method and apparatus for applying adhesive to at least the leading edge of the first to be applied label as it is held stationary with respect to a moving conveyor means.

The apparatus and method for synchronizing roll fed labels with an article to be labelled can advantageously be used with labels which have a heat sensitive adhesive previously applied which is heated as the label is held stationary on the conveyor or a label supply which has a solvent reactivated adhesive which is reactivated as the label to be applied is on the conveyor.

BRIEF DESCRIPTION OF THE DRAWINGS

Preferred embodiments of the invention are shown in the drawings wherein,

FIG. 4 is a partial perspective view of the labelling apparatus adjacent the labelling location showing a mechanism for applying adhesive to the trailing edge of the first to be applied label, as the label is being applied to an article;

FIG. 5 is a partial top view of the labelling apparatus adjacent the labelling location and;

DETAILED DESCRIPTION OF THE PREFERRED EMBODIMENTS

Figure 1:
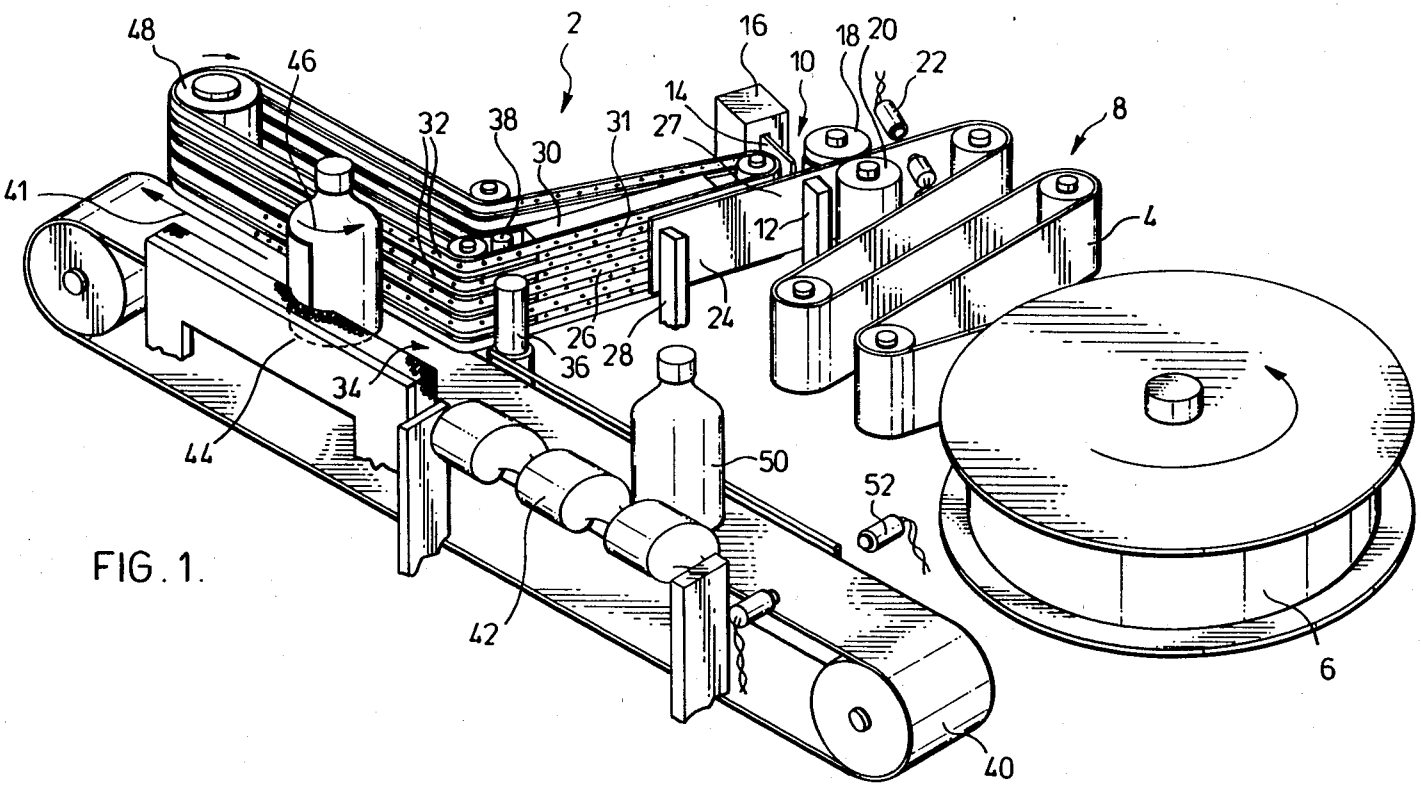
FIG. 1 is a partial perspective view of the labelling apparatus.

The labelling apparatus 2, withdraws labels from the label roll supply 6, to form a long strip 4, which is threaded through a label tensioning arrangement, generally designated as 8, prior to feed of the strip through the cutting mechanism 10. The cutting mechanism 10 includes a stationary blade 12 and a driven blade 14, operated by the drive mechanism 16, synchronized with the movement of the article conveyor 40. The label supply 6, is preferrably driven, however, in addition, the pinch rollers 18 and 20 upstream the cutting mechanism 10, accurately position the first to be applied label 24 as they are partially controlled by photosensing mechanism 22 which senses a registration mark on the label, such as the bar code. The pinch rollers, 18 and 20 are geared together and driven to cause advance of the strip 4 with rotation of the roller. By appropriately sensing the mark on the series of labels, the first to be label 24 is accurately positioned in the cutting mechanism 10 for cutting thereof from the series of labels. However, prior to cutting of label 24 from the series of labels 4, an adhesive is applied to at least the leading edge 26 of the first to be applied label, while the label is held stationary on the stationary vacuum bed 30. The vacuum bed has a plurality of ports 31, through which a vacuum is applied to pull the label into engagement with the vacuum bed 30. Intermediate the bed and the first to be applied label, a number of continuously driven belts 32 initially have a slipping relationship with the first to be applied label 24, and subsequently cause the label to advance after it has been cut from the series of labels 4. With the first to be applied label appropriately positioned and held by pinch rollers 18 and 20, hot melt spray applicator 28 is activated and spits hot melted adhesive to the leading edge 26 of the first to be applied label 24. This adhesive is applied while the label is held stationary and, therefore, the accuracy of application of the adhesive can be quite precise. Various adhesive spray patterns can be used such as a series of circles dots or continuous strip.

Articles to be labelled, in this case bottles 50, are advanced by conveyor 40 and the screw advance mechanism 42. A photo-sensing mechanism 52 provides an appropriate signal to advance the first to be applied through the cutting mechanism 16 and photosensor 22, senses a bar code, for example, to stop the label advance when the first to be applied label 24 is accurately positioned for cutting the label from the label supply. Adhesive is applied as the label 24 is held stationary on the vacuum bed 30, and cutting mechanism 16 then sets free the label 24 in timed synchronization the advance of the article to be labelled. The freed label is carried by belts 32 to the labelling location 34, such that the leading edge 26 strikes the surface of a bottle to be labelled as it is moving through the labelling location 34. The bottle contacts the compressible rail 44, which serves to engage the one edge of the bottle in a mannner whereby the movement of belts 32 will cause the label to be brought into pressure contact with the bottle and wrap the label about the bottle. In wrap application of labels the belts are driven at twice the speed of the conveyor 40.

The cutting mechanism 16 is mechanically driven by the main drive of the labeller which also drives the feed screw 42. With this arrangement the cutting mechanism operates with or without a label and the synchronization of the label and the positioning thereof is determined by the pinch rollers 18 and 20 and the clutch/-brake 74. The pinch rollers only advance a label through the cutting mechanism when an article to be labelled has been sensed at the feed screw 42. The advance through the cutting mechanism of the label to be applied, the application of the adhesive to the leading edge of the label or the reactivation of adhesive previously applied, the cutting of the label, and the advance of the label to the labelling location are all completed during the time the article to be labelled is sensed and moved to the labelling location 34. It is preferred to mechanically interconnect and synchronize the feed screw 42 with cutting mechanism 16 however electrical synchronization could be used and the cutting mechanism could be activated when required. This would allow "pre-positioning" of the label in the cutting mechanism prior to sensing of an article if desired.

From the above description, it can be understood that a label is brought to the labelling location 34, in time synchronization with the movement of an article to be labelled and strikes a surface of the article to be labelled with the label subsequently being wrapped about the article due to a caused rotation of the article to be labelled. In the case where the leading edge of the label has an adhesive applied thereto, it will be necessary to at least apply adhesive to or reactivate adhesive on the trailing edge 27 of the label 24. This second application of adhesive is accomplished adjacent and upstream of the labelling location 34. If reactivated adhesive is used it could be reactivated as the label if moved along the conveyor or when it is stationary thereon. Solvent reactivated adhesive are preferrably reactivated as the label is moved by a wipe application of solvent whereas heat reactivated adhesive is preferably activated when the label is stationary. In the reactivated application the roll of labels will have a previously applied adhesive which requires reactivation to adhere. Adhesives of this type are normally solvent or heat reactivated although the system is not limited thereto. The vacuum bed conveyor allows application of an adhesive or reactivation of an adhesive on the first to be applied label during the time the label is advanced to the labelling location. The vacuum bed 30, is spaced from the point of labelling 34 such that only the belts 32, advance the portion of the label between vacuum bed 30 and the point of labelling 34. A substantial portion of the label remains in engagement with vacuum bed 30 and, therefore, the leading edge of the label is not prone to curling or bending which would render the label difficult to apply. In addition, it has been found that a static charge may be produced, due to the slipping of the belts relative to the label as it is held stationary at the cutting mechanism, and this charge urges the label into contact with the belt. Intermediate the point of labelling and the end of the vacuum bed conveyor, glue is applied to or reactivated on the trailing edge of the label. As the trailing edge of the label is advanced past air blast column 38, a timed air blast forces the trailing edge of the label against a stationary glue column 36. This glue column has a film of preferrably hot melt adhesive on the surface thereof, generally designated as 37, and the adhesive is transferred to the trailing edge 27 as it moves across the glue column. In the case of a solvent reactivated adhesive, column 36 would apply a solvent. Further rotation of the article to be labelled, produces a secured full wrap label or partial wrap label about a bottle 50.

Although a separate motor and drive arrangement is shown the clutch/brake 74 could be driven by a shaft connected to the main drive of the labeller. This avoids the additional cost of the separate motor 72.

Figure 2:
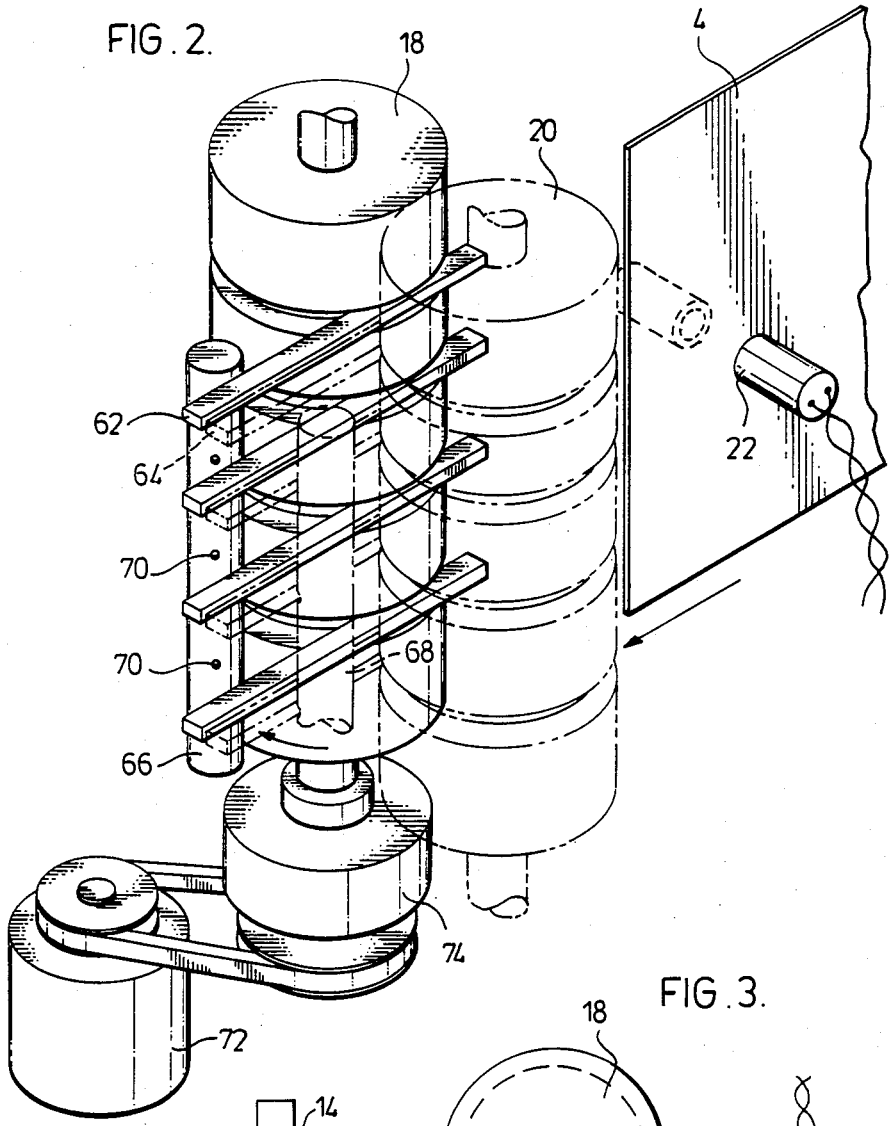
FIG. 2 is a partial perspective view of the label feed advance system which holds the first to be applied label stationary for application of an adhesive.
Figure 3:
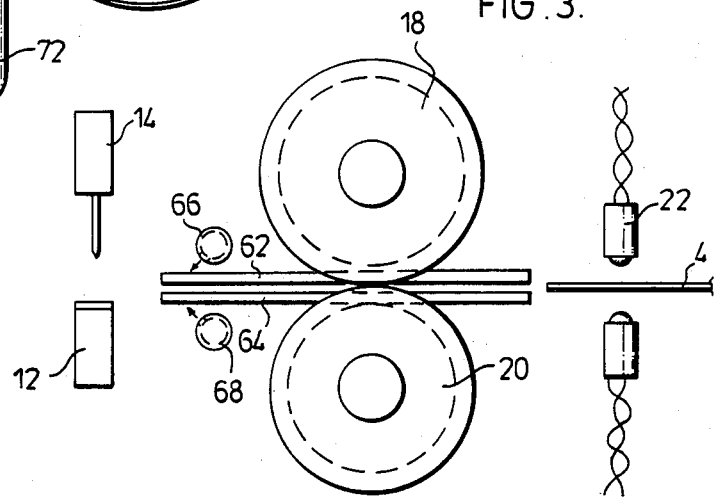
FIG. 3 is a partial top view of the pinch roller drive system for advancing and holding labels adjacent the cutting mechanism.
Figure 6:
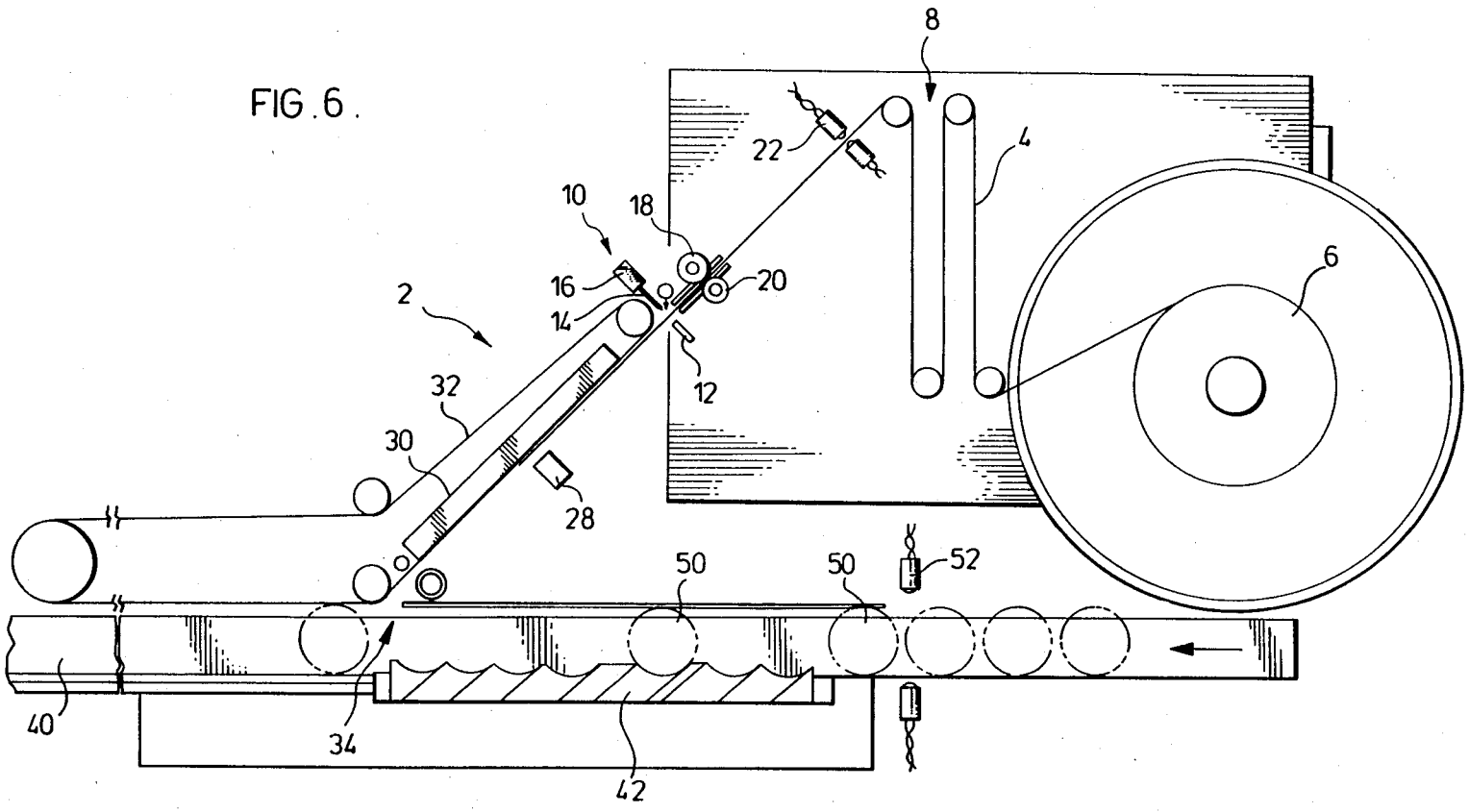
FIG. 6 is a top lay-out of the labelling apparatus.

Details of the label advance adjacent the cutting mechanism 10 is shown in FIGS. 2 and 3. The pinch roller 18, is driven and engaged at the appropriate times via the motor 72 and the clutch/brake 74.

Each of the pinch rollers 18 and 20 have sloted areas in the length thereof for receiving opposed guide bars 62 and 64, which engage the label either side thereof and either side of the pinch rollers as the label passes through the pinch rollers. These guide bars assure that rotation of the pinch rollers 18 and 20 cause an advance of the label along a predetermined path to the cutting mechanism and in effect strips the label from the surface of the pinch rollers. Downstream of the pinch rollers 18 and 20 and upstream of the cutting mechanism 10, air blast columns 66 and 68 produce an air blast at an inclined angle relative to the axis of travel of the label urging the same through the cutting mechanism 10. This air blast is continuous and produces a tugging action urging the label away from the pinch rollers 18 and 20. It should be noted that the guide bars 62 and 64 are of a length to assure that the series of labels advances through the cutting mechanism 10 after cutting of the first to be applied label and the air blast resulting from the air blast column 66 and 68 assist in the advance of the labels. The series of labels may be prone to curling, and guide bars 62, 64 and the air blast created by the air blast column 66 and 68 cooperate to provide positive advance of the series of labels through the cutting mechanism 16.

FIGS. 4 and 5 illustrate further details of the structure for applying adhesive to the trailing edge 27 of the label 24. Air blast column 38 has plurality of ports 78, and pressurized air is introduced to the air column via conduit 76. The air blast is suitably timed to force the trailing edge 27 of what was the first to be applied label 24, against the glue column 36 to transfer adhesive to the back face of the label adjacent the trailing edge. The air blast is schematically illustrated by arrows 80. The trailing edge 27 has cleared the stationary vacuum bed 30 and is only held against the belts due to any static charge and/or its tendency to remain in contact with the belts due to its previous movement. Either of these biases are easily overcome by an appropriately timed air blast which will deflect the label in a manner to cause application of adhesive thereto. Further advance of the label as the bottle rotates causes a wiping action of the label over glue column 36. Excessive adhesive build up at the edges of the label is not a problem due to the minimal application pressure. As label 24, is advanced over the vacuum bed 30 via the belt 32, the series of labels has advanced through the cutting mechanism 16 to accurately position the next first to be applied label designated as 24*a* in FIG. 5, and is holding the same stationary opposite the hot melt adhesive spray gun 28. As the label is held in the stationary position, adhesive is sprayed on the leading edge.

It can be appreciated that other arrangements can be provided for applying adhesive to the label, and in particular this apparatus and method can easily be adapted for applying adhesive to the length of a label, if desired. The combination of the stationary vacuum bed, continuously driven belts, and the holding of the series of labels stationary prior to cutting of the first to be applied label from such series, provides a particularly easy combination to manufacture and allows convenient synchronization of the first to be applied label with a suitably advanced article to be labelled. This combination is not limited to applying wrap labels to cylindrical or near cylindrical articles to be labelled as the method and apparatus can easily be adapted to apply labels to boxes or generally rectangular in cross section bottles as but one example. Furthermore, other means of applying adhesive to the back face of the label are possible, and although the invention has been particularly described with respect to the improvements possible by at least applying adhesive to or reactivating adhesive on a portion of the label while the first to be applied label is held stationary integral with the series, other arrangements are possible For example, the label could be cut with the trailing edge releasably held by gripping means for suitable timed release.

The labelling machine 2 is easily adjusted to allow changeover for applying a label of a label of a different length. Hot melt spray applicator is appropriately positioned as it is mountable in various positions relative to the length of the vacuum bed 30 and sensing mechanisms 22 and 52 are adjustably positioned to allow synchronization of the apparatus when changed over for labels of a different length. This allows the cutting mechanism 16, the pinch rollers 18 and 20 the vacuum bed 30 and the continuously driven belts 32 to remain fixed. This arrangement allows fast changeover as set up is simple and repeatable as the components are moved to known positions.

Although various preferred embodiments of the present invention have been described herein in detail, it will be appreciated by those skilled in the art, that variations may be made thereto without departing from the spirit of the invention or the scope of the appended claims.

The embodiment of the invention in which an exclusive property or privilege is claimed are defined as follows:

1. A roll fed labelling apparatus for applying a label to an article as it is moved past a labelling location comprising a label supply, cutting means for cutting a first label from the end of such label supply, means for intermittently advancing labels through said cutting means, conveyor means for transporting such first label in timed sequence with advancement of an article to be labelled, means for applying adhesive to at least the leading edge of such first label with such label held essentially stationary on said conveyor means, means for applying an adhesive to at least the trailing edge of such first label, means for applying such label to such article to be labelled and means for synchronizing the advance of the first to be applied label with such article to be labelled.

2. A roll fed labelling apparatus as claimed in claim 1, wherein conveyor means includes a vacuum bed and at least two belts moving over the surface of said vacuum bed, said conveyor means being positioned to engage the leading portion of such first label with the same attached to and held by such label supply with said vacuum bed assisting to maintain such first label stationary and said belts slipping against such first label in preparation for applying adhesive to such first label and the subsequent cutting such first label from such label supply to be synchronized with such article to be labelled.

3. A roll fed labelling apparatus as claimed in claim 1, wherein said cutting mechanism is controlled to cut such first label in a manner to cause advancement thereof by said conveyor means in synchronization with the advance of an article to be labelled.

4. A roll fed labelling apparatus as claimed in claim 2, wherein said means for applying adhesive to the trailing edge of such first label includes a glue coated member downstream of said vacuum bed and offset to the opposite side of such labels such that said vacuum bed engages one side of such labels and said glue coated member contacts at least a portion of the opposite side of such label and positioned to normally not be in contact therwith and biasing means for forcing such trailing edge into engagement with said glue coated member.

5. A roll fed labelling apparatus as claimed in claim 4, wherein said biasing means is means for providing an air blast.

6. A roll fed labelling apparatus as claimed in claim 4, wherein said vacuum bed is spaced from the initial point of contact of such first label and an article to be labelled a distance less than half the length of such first label and said belts are guided to continue to advance the leading edge of such first label and bring the same into contact with such article to be labelled.

7. A method of applying the first label of a roll-fed label supply to an article comprising, intermittently advancing labels through a cutting mechanism for severing the first label from such label supply, engaging at least a portion of such first to be applied label with a belt conveyor means downstream of such cutting mechanism to permit slippage between such first label and such conveyor means while such first label is held essentially stationary, holding such first label essentially stationary and treating at least the leading edge of such first label with such first label stationary to cause an adhesive to be present at the leading edge in a condition to secure such first label with such article to be labelled by pressure contact therebetween, causing an adhesive to be present on the trailing edge of such first label in a condition suitable for securing the trailing edge to such article by contact pressure contact therewith, cutting such first label from such label supply and releasing such first label causing the same to be advanced by said conveyor means in timed synchronization with an article to be labelled and, applying such label to an article to be labelled by bringing the same into pressure contact.

8. A method as claimed in claim 7, wherein adhesive is applied to the trailing edge of such first label after cutting thereof from the label supply by biasing the trailing edge from the normal path of travel and into contact with a glue applicator as it is moved by said conveyor means.

9. A method of applying a label withdrawn from a roll feed label supply and applying the same to an article to be labelled comprising advancing such labels in strip form toward a cutting mechanism and in a manner to appropriately position such first label for cutting thereof from such label supply with the leading edge of such first label clear of such cutting mechanism, holding such first label stationary for a period of time, applying an adhesive to or reactivating an adhesive on at least the leading edge of an appropriately positioned and held first label prior to cutting such first label from such label supply, engaging such first label with a vacuum conveyor means as such label is held in preparation for advancing such first label to a labelling location, and cutting such first from such label supply causing advance of the same to the label location by said conveyor means and in timed synchronization with an article to be labelled, and applying such label to such article to be labelled.

10. A method as claimed in claim 9, including sensing a registration mark on each label as such labels are advanced in strip form toward a cutting mechanism and interrupting the advance of such strip labels in accordance with the sensed registration mark to accurately position such first to be applied label for cutting thereof, and sensing the advance of an article to be labelled which is used to time the cutting of such first label to synchronize the same with such article to be labelled.

11. A labelling machine for applying roll-fed wraparound labels printed on one side to containers comprising an advance mechanism for a roll-fed label supply to advance label sequentially towards a cutting station, a label cutting station for cutting the first label from the label supply, said cutting station including pinch rollers driven to intermittently advance such first label and hold such first label by engaging and holding stationary the next to be applied label for cutting of such first label from the label supply, a combination vacuum bed and belt conveyor system positioned to at least partially engage the printed side of such first label prior to cutting thereof from such label supply and to advance such first label upon cutting thereof from such label supply and bring the same into synchronized contact with a container to be labelled, and adhesive means associated with such conveyor system for causing adhesive to be present on at least the leading edge and trailing edge of such first label, said combination vacuum bed and belt conveyor having a stationary generally planar vacuum bed over which the labels are advanced, said vacuum bed having a plurality of ports through which a vacuum source acts on the printed side of such labels to draw the same into engagement with the vacuum bed and at least two belts driven to move over said vacuum bed for advancing such first to be applied label from said cutting mechanism to the container to be labelled, said vacuum bed being spaced from said point of labelling such that at least the leading edge of such first to be applied label after cutting from such supply has cleared said vacuum bed prior to contacting a container to be labelled.

12. A labelling machine as claimed in claim 11, including means for sensing a registration mark on each label, said means for sensing a registration mark at least partially controlling said pinch rollers and thereby appropriately positioning the first to be applied label within said cutting station, and means for sensing the advance of a container to be labelled and using the same to cut such first to be applied label from such label supply and effect synchronization of such first label and such container to be labelled, said pinch rollers having a plurality of associated guide bars which pass through and extend either side of said pinch rollers to contact the labels either side of the pinch rollers and define a label path of travel through and beyond said pinch rollers.

13. A labelling apparatus as claimed in claim 2, wherein said belts are continuously driven and have a portion of their path of travel parallel to the direction of travel of the article to be labelled to contact the same for transferring a label from the belts to the article.

14. A labelling apparatus as claimed in claim 13, wherein the articles to be labelled contact said belts which cause rotation of the article to be labelled in a manner to progressively wrap a label delivered by said belts to the article about to be labelled.

15. A labelling apparatus as claimed in claim 4, wherein the belts are driven to have a linear speed of travel twice the rate of travel of the articles to be labelled.

16. A labelling apparatus as claimed in claim 1, wherein said cutting means is continuously driven and the advance of labels through said cutting means is limited by said synchronizing means.

17. A labelling apparatus as claimed in claim 2, wherein said means for applying adhesive to at least the leading edge of such first label includes an adhesive applicator which when actuated applys a controlled spit of adhesive to such label, said means for applying adhesive to at least the leading edge being actuated by said synchronizing means.

18. A labelling apparatus as claimed in claim 1, wherein said cutting means is controlled by said synchronizing means to cut the first to be applied label from such label supply and thereby synchronize such first label with such article to be labelled.

19. A labelling apparatus as claimed in claim 2, wherein said means for synchronizing and said means for applying adhesive to at least the leading edge are adjustably located along the path of travel of the labels to accommodate change over from a label of a given length to a label of a different length while the position of said cutting means and said conveyor means remains fixed.

20. A labelling apparatus as claimed in claim 19, wherein said means for synchronizing includes a sensor upstream of said cutting means and positioned to sense a predetermined mark each inch label and a separate sensor for indicating an article to be labelled is being advanced for labelling, each of said sensors being movable to allow proper placement thereof to effect synchronization of an article to be labelled and such first label for a given length thereof.

* * * * *